US005364188A

United States Patent [19]

Godfried et al.

[11] Patent Number: 5,364,188

[45] Date of Patent: Nov. 15, 1994

[54] CORNER GATHERED LAWN AND LEAF BAG WITH ADHESIVE ATTACHMENT MEANS

[76] Inventors: Alan Godfried, 2 Cranbury Rd., Westport, Conn. 06880; Peter J. Dronzek, Jr., 6 Poe Rd., Thornwood, N.Y. 10594

[21] Appl. No.: 153,621

[22] Filed: Nov. 17, 1993

Related U.S. Application Data

[63] Continuation-in-part of Ser. No. 7,488, Jan. 25, 1993.

[51] Int. Cl.[5] ..... B65D 33/18

[52] U.S. Cl. ..... 383/4; 383/71

[58] Field of Search ..... 383/4, 71

[56] References Cited

U.S. PATENT DOCUMENTS

| | | | |
|---|---|---|---|
| 219,080 | 9/1879 | Edwards | 383/4 X |
| 732,838 | 7/1903 | Edwards | 383/4 X |
| 1,385,695 | 7/1921 | MacCormack et al. . | |
| 1,871,101 | 8/1932 | Waltz . | |
| 2,479,203 | 8/1949 | Brown . | |
| 2,749,957 | 6/1956 | Smith . | |
| 2,766,797 | 10/1956 | Cowen . | |
| 3,202,193 | 8/1965 | Ware | 383/4 X |
| 4,366,949 | 1/1983 | Staub, Sr. . | |
| 4,682,447 | 7/1987 | Osborn | 383/4 X |
| 4,744,509 | 5/1988 | Büchler-Dopheide . | |
| 4,754,914 | 7/1988 | Wischusen, III | 229/87.08 X |
| 4,813,794 | 3/1989 | Herrington . | |
| 4,938,607 | 7/1990 | Kelley . | |
| 4,955,069 | 9/1990 | Tennihan . | |

*Primary Examiner*—Allan N. Shoap
*Assistant Examiner*—Jes F. Pascua
*Attorney, Agent, or Firm*—Hedman, Gibson & Costigan

[57] ABSTRACT

A corner gathered lawn and leaf bag which is a flat sheet upon which lawn debris is raked or blown. The corners of the sheet are gathered and adhered together such that the debris raked onto the sheet is contained thereby.

9 Claims, 2 Drawing Sheets

CORNER GATHERED LAWN AND LEAF BAG WITH ADHESIVE ATTACHMENT MEANS

CROSS-REFERENCE TO RELATED APPLICATIONS

This application is a continuation-in-part of copending application Ser. No. 08/007,488, filed Jan. 25, 1993.

FIELD OF THE INVENTION

The present invention relates to a disposal system for easy and efficient containment of lawn debris and fallen leaves, and in particular to a flat polygonal shaped sheet which is gathered by its corners after the debris has been placed thereon and the corners are adhesively attached.

BACKGROUND OF THE INVENTION

Prior art bags for containment of lawn debris and fallen leaves are usually large plastic or paper bags. After collecting lawn debris and fallen leaves in a pile, usually by raking or blowing, the user will then hold open the bag and attempt to simultaneously bend over, scoop up a portion of the debris with his arms, and place the debris into the bag. When the typical plastic bag is full, the user usually closes the bag, either by pulling on a self-contained drawstring or gathering the top portion of the bag and tieing it with a plastic or wire "twist tie". To close paper bags the user must fill a smaller volume of the bag and fold it over the top.

This common method of containing lawn debris is disadvantageous for a number of reasons. First, the user must perform two time consuming acts—the initial raking of debris into a pile, and then the scooping of the debris into the bag.

Second, it is quite difficult to simultaneously hold open the bag and scoop debris into the bag. Thus, two people are usually required to contain the debris—one to hold open the bag, and one to scoop the debris into the bag.

Third, the common type of plastic bag utilizes no built in mechanism for closing the bag; rather, a separate twist tie is often required. Twist ties tend to become misplaced, which leaves the user with no way to close the bag. Although some bag embodiments utilize a twist tie that is tacked onto the top of the bag, this method is not foolproof since they too can become detached and lost. Moreover, although the drawstring type bag alleviates this particular problem, such drawstring bags are more expensive to manufacture and thus more costly to the consumer.

Fourth, it is often desired to recycle the debris, and this prior art method of debris containment in plastic bags affords no practical opportunity to remove the bag prior to recycling. That is, once the debris is sealed in the bag, it is a time consuming task to empty the debris onto a mulching pile or other type of recycling environment.

U.S. Pat. No. 4,955,068 discloses a leaf disposal bag formed by a plastic circular sheet. A drawstring is threaded through the sheet, leaves are raked onto the sheet, and the drawstring is pulled tightly in order to close the bag around the leaves. This bag is disadvantageous since the threaded drawstring requires a more costly manufacturing process. In addition, this prior art bag can only be emptied onto a mulching pile by sliding the drawstring and shaking the up-ended bag to remove the contents.

It is therefore an object of the present invention to provide a lawn and leaf bagging system which overcomes the above described problems of the prior art.

In particular, it is an object of the present invention to provide a lawn and leaf bagging system which decreases the amount of time required to gather and contain lawn debris.

It is a further object of the present invention to provide a lawn and leaf bagging system which can be used by one person and does not require a second person during the containment stage.

It is a further object of the present invention to provide a lawn and leaf bagging system which can be adhesively closed without requiring a separate twist tie mechanism or internally threaded drawstring.

It is a further object of the present invention to provide a lawn and leaf bagging system which allows quick and easy release of the debris contained therein at a recycling or mulching site by cutting the fastening means and jerking the sheet open to permit the contents to slide into the desired location.

It is a further object of the present invention to provide a lawn and leaf bagging system which is made from recyclable materials so the system can be disposed with its contents at a recycling or mulching site.

SUMMARY OF THE INVENTION

In accordance with these and other objects, provided is a bag for containing lawn debris comprising a flat sheet of regular polygonal shape, the sheet comprising a plurality of corners and a plurality of edges connecting the corners. At least some of the corners are disposed with adhesive on at least one face thereof and none of the edges are disposed with adhesive. The bag is formed by gathering and adhering the corners together wherein a handle is formed by the gathered and adhered corners such that a user's hand may be inserted through any of the open areas between adjoining non-adhered edges and may grasp the handle to effect transport of the formed bag. In one embodiment, the adhesive is disposed on all the corners, and it is a cohesive adhesive; in a second embodiment, the adhesive disposed on the corners is a pressure sensitive adhesive disposed with a protective peel-away backing and the backings are removed prior to formation of the bag.

The method of collecting lawn debris of the present invention comprises the steps of providing a flat sheet of regular polygonal shape, the sheet comprising a plurality of corners and a plurality of edges connecting said corners, the corners being disposed with cohesive adhesive on at least one face thereof. Lawn debris is then raked or blown onto the sheet, and the corners are gathered and adhered together to contain the debris within the bag formed thereby. In a second embodiment, a pressure sensitive adhesive with protective peel-away backings is used instead of cohesive adhesive, and the backings are removed prior to adhering the corners together.

DESCRIPTION OF THE PREFERRED EMBODIMENT

Figure 1:
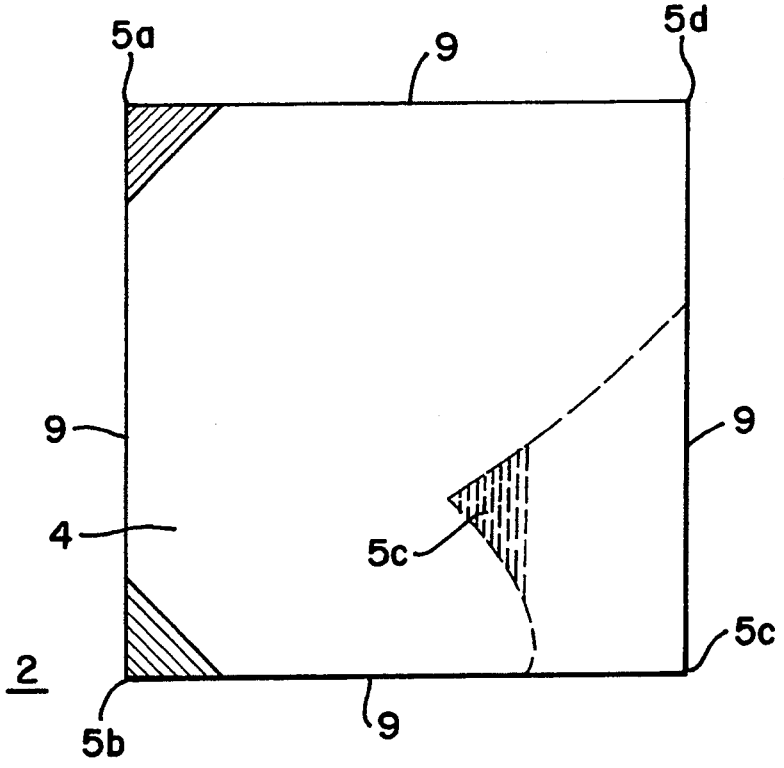
FIG. 1 is a top plan view of the preferred embodiment of the present invention.

Referring to FIG. 1, the bag 2 of the present invention comprises a flat sheet 4. The flat sheet 4 is of regular polygonal shape, and in the preferred embodiment the flat sheet 4 is a square and comprises four corners 5 and four edges 9.

The corners 5 are disposed with an adhesive on one or both sides of the sheet for forming the bag. In the preferred embodiment, a cohesive adhesive such as NIP WELD C1003 cohesive coating marketed by Findley Adhesives Inc. is used. The corners coated with cohesive adhesive will adhere, under light to moderate pressure, only to each other and will not adhere to uncoated areas of the sheet 4. Desirably, leaves and other debris will also be unable to adhere to the cohesive adhesive coated corners 5, thus ensuring uncontaminated bonding of the corners.

In the preferred embodiment, cohesive adhesive is disposed on two adjacent corners on one face, shown as corners 5*a* and 5*b* in FIG. 1, and on two adjacent corners on the opposite face, shown as corners 5*c* and 5*d*. The dotted line shows the opposite face of corner c in the turned-over position. Corner 5*a* can be adhered to its opposed, paired corner 5*c*, and corner 5*b* can be adhered to its opposed, paired corner 5*d*.

Figure 2:
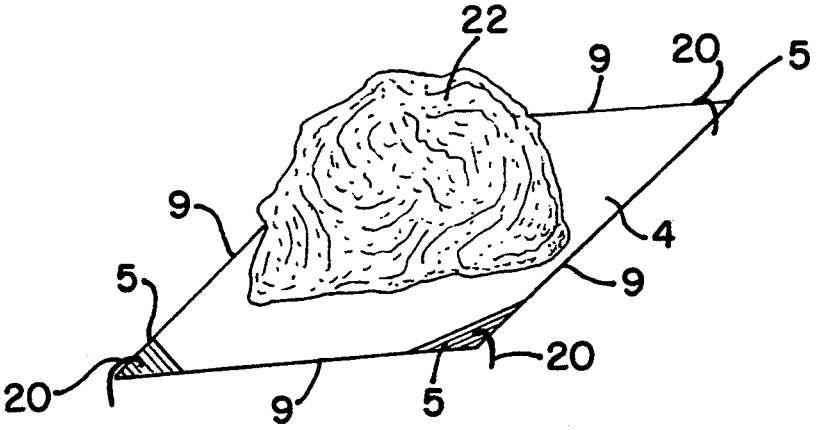
FIG. 2 is a perspective view of the sheet of FIG. 1 secured to the ground by stakes and loaded with lawn debris.
Figure 3:
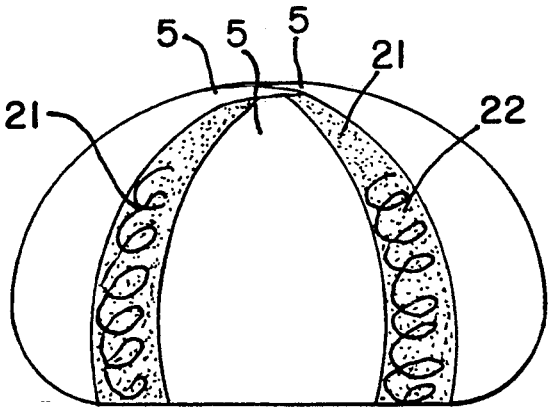
FIG. 3 is an illustration of the bag of FIGS. 1 and 2 after the corners have been gathered around debris raked thereon and adhesively attached to each other.
Figure 4:
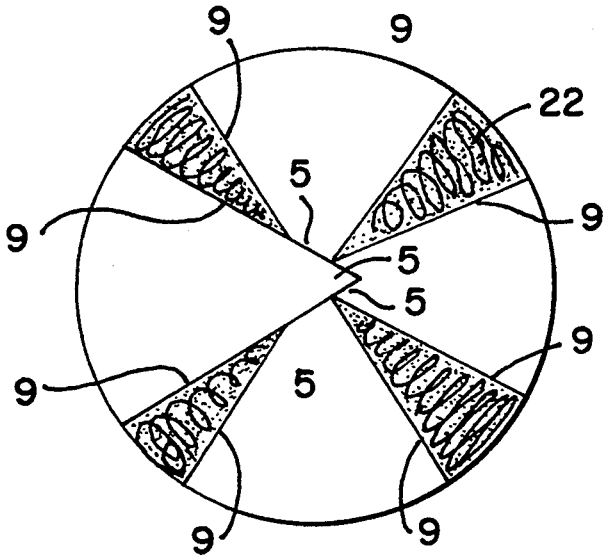
FIG. 4 is a top plan view of the gathered bag of FIG. 3.

Referring to FIG. 2 through 4, the bag 2 is utilized as follows. A pile 22 of lawn debris and/or fallen leaves is raked or blown into a pile on the flat sheet 4. When a sufficiently large amount of debris is on the sheet 4, the corners 5 are gathered together over the middle of the pile of debris, and the corners are centrally gathered and adhesively applied to each other to enclose the debris within. Since the adhesive used in the preferred embodiment is of the cohesive type, leaves will not inadvertantly adhere to the corners, thus ensuring an uncontaminated bonding of the corners.

By applying cohesive adhesive to both sides of each of the corners 5, the corners 5 can be bonded to each other in any convenient way after they have been gathered together. In the alternative, diagonally opposite corners can be coated with cohesive adhesive on opposite sides only in order to reduce manufacturing costs, as described above.

Since the edges 9 are not coated with adhesive, they will not adhere to each other after the bag is formed. As such, openings 21 are formed where adjoining edges 9 meet, as shown in FIGS. 3 and 4. A user may grasp the bag by placing his hand inside any of the openings 21 and holding the adhered corners 5 to effect transport of the bag as desired.

The bag 2 of the preferred embodiment thus eliminates the need to first rake the debris and then scoop the debris into an open bag. In addition, only one person is required to perform the containment of the debris, since the need for someone to hold open the bag while the debris is scooped and placed therein is eliminated. In addition, the user does not have to constantly bend over and pick up the debris. Importantly, the requirement of a drawstring is obviated by the adhesive corner gathering means of the present invention.

The sheet 4 can optionally be held in place by inserting stakes 20 into the ground at strategic locations around the periphery of the sheet 4. For example, as shown in FIG. 2, four stakes 20 secure each of the corners 5 snugly against the ground. After the debris has been raked onto the sheet, the stakes 20 are removed and the corners 5 gathered as described above.

The flat sheet 4 can be made of any material known in the industry suitable for making a leaf disposal bag. For example, polyethylene or propylene of varying densities, kraft paper, woven paper or recycled paper are suitable. By using paper, the filled bag is entirely compostable and can be placed in its entirety into a compost pile. In addition, by using a woven material, the debris contained inside the bag will be more exposed to the elements and will thus decompose at a faster rate. If a plastic non-degradable material is used, the filled bag can be held over a compost pile and the adhered corners 5 can be easily cut or ripped open so as to allow the debris within to fall out easily.

Practice has shown that thicknesses of the fiat sheet 4 can range from 1.5 mil to 3.5 mil. In the preferred embodiment, the flat sheet 4 is 6′ by 6′, which will hold the same amount of lawn debris as two conventional leaf bags. In the alternative, a 4′ by 4′ bag will hold the same amount of lawn debris as one conventional leaf bag.

The shape of the flat sheet 4 in the preferred embodiment is a square. It is contemplated, however, that any regular shaped polygon may be used; e.g. a triangle, a hexagon, an octagon, etc. In the case of a hexagon, for example, there will be six corners 5 gathered and secured together accordingly.

In an alternative embodiment, pressure-sensitive adhesive is used instead of cohesive adhesive. For example, MORSTIK 219 Adhesive marketed by Morton International, Inc. was found to provide suitable results. A peel-away backing must be applied over each corner coated with the pressure-sensitive adhesive in order to prevent undesirable bonding of the corners prior to formation of the bag. After the debris is placed on the sheet and the corners are gathered, the peel-away backings are removed and the corners are adhered to each other to form the bag.

While the present invention has been described in connection with the exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

We claim:

1. A bag for containing lawn debris comprising a flat sheet of regular polygonal shape, said sheet comprising one face and an opposite face, a plurality of corners and a plurality of edges connecting said corners, wherein at least one of said corners is disposed with adhesives on said one face thereof and another of said corners is disposed with adhesive on said opposite face and the remainder of said one face and said opposite face are free of adhesive, said bag being formed by gathering and adhering said corners together wherein a handle is formed by the gathered and adhered corners and open areas are formed by the non-adhered edges such that a user's hand may be inserted through any of the open areas between adjoining non-adhered edges and may grasp said handle to effect transport of the formed bag.

2. The bag of claim 1 in which said polygonal shape is a square, and in which two adjacent corners are disposed on said one face with said adhesive, and in which the other two adjacent corners are disposed on said opposite face with said adhesive.

3. The bag of claim 2 further comprising means to secure said sheet to the ground during the raking of debris onto the sheet, said means being removable such that said corners can be gathered and secured together after raking or blowing is performed.

4. The bag of claim 3 in which said securing means are staked which secure at least some of said corners to the ground.

5. The bag of claim 2, wherein said adhesive disposed on said corners is a cohesive adhesive and the thickness of the flat sheet is 1.5 mil to 3.5 mil.

6. The bag of claim 1 in which said sheet is made of paper.

7. The bag of claim 1 in which said sheet is made of thin plastic.

8. A bag for containing lawn debris as in claim 1, wherein said adhesive disposed on said corners is a pressure sensitive adhesive disposed with a protective peel-away backing and said backings are removed prior to formation of said bag.

9. A bag for containing lawn debris as in claim 1, wherein said adhesive disposed on said corners is a cohesive adhesive.

* * * * *